US010350676B2

(12) United States Patent
Miyazaki et al.

(10) Patent No.: US 10,350,676 B2
(45) Date of Patent: Jul. 16, 2019

(54) SPRING STEEL WITH EXCELLENT FATIGUE RESISTANCE AND METHOD OF MANUFACTURING THE SAME

(71) Applicant: NIPPON STEEL & SUMITOMO METAL CORPORATION, Tokyo (JP)

(72) Inventors: Masafumi Miyazaki, Kisarazu (JP); Hideaki Yamamura, Sendai (JP); Masayuki Hashimura, Kisarazu (JP); Takashi Fujita, Kisarazu (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 716 days.

(21) Appl. No.: 14/785,815

(22) PCT Filed: Apr. 23, 2013

(86) PCT No.: PCT/JP2013/061877
§ 371 (c)(1),
(2) Date: Oct. 20, 2015

(87) PCT Pub. No.: WO2014/174587
PCT Pub. Date: Oct. 30, 2014

(65) Prior Publication Data

US 2016/0151832 A1 Jun. 2, 2016

(51) Int. Cl.
*C21C 7/00* (2006.01)
*B22D 11/11* (2006.01)
(Continued)

(52) U.S. Cl.
CPC ..... *B22D 11/11* (2013.01); *B22D 11/001* (2013.01); *B22D 11/113* (2013.01);
(Continued)

(58) Field of Classification Search
CPC ..... B22D 11/11
See application file for complete search history.

(56) References Cited

U.S. PATENT DOCUMENTS 5,415,711 A * 5/1995 Takagi ..... C22C 38/02 148/328
2005/0025658 A1* 2/2005 Matsui ..... C22C 38/02 420/124
(Continued)

FOREIGN PATENT DOCUMENTS

CN 1764733 A 4/2006
CN 1851025 A 10/2006
(Continued)

OTHER PUBLICATIONS

International Search Report dated Jul. 30, 2013 issued in corresponding PCT Application No. PCT/JP2013/061877 [with English Translation].
(Continued)

*Primary Examiner* — Colleen P Dunn
*Assistant Examiner* — Rajinder Bajwa
(74) *Attorney, Agent, or Firm* — Birch, Stewart, Kolasch & Birch, LLP

(57) ABSTRACT

A spring steel includes a predetermined chemical composition and a composite inclusion having a maximum diameter of 2 μm or more that TiN is adhered to an inclusion containing REM, O and Al, in which the number of the composite inclusion is 0.004 pieces/mm$^2$ to 10 pieces/mm$^2$, the maximum diameter of the composite inclusion is 40 μm or less, the sum of the number density of an alumina cluster having the maximum diameter of 10 μm or more, MnS having the maximum diameter of 10 μm or more and TiN having the maximum diameter of 1 μm to 10 pieces/mm$^2$.

4 Claims, 1 Drawing Sheet

(51) Int. Cl.

| | |
|---|---|
| ***C22C 38/26*** | (2006.01) |
| ***C22C 38/24*** | (2006.01) |
| ***C21C 7/06*** | (2006.01) |
| ***C22C 38/00*** | (2006.01) |
| ***C22C 38/58*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/28*** | (2006.01) |
| ***C22C 38/32*** | (2006.01) |
| ***C22C 38/34*** | (2006.01) |
| ***C22C 38/40*** | (2006.01) |
| ***C21C 7/10*** | (2006.01) |
| ***C21D 8/06*** | (2006.01) |
| ***C21D 9/02*** | (2006.01) |
| ***B22D 11/00*** | (2006.01) |
| ***B22D 11/113*** | (2006.01) |
| ***B22D 11/114*** | (2006.01) |
| ***C21D 1/26*** | (2006.01) |
| ***C21D 6/00*** | (2006.01) |
| ***C22C 38/02*** | (2006.01) |
| ***C22C 38/08*** | (2006.01) |
| ***C22C 38/14*** | (2006.01) |
| ***C22C 38/16*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.

CPC ..... *B22D 11/114* (2013.01); *C21C 7/0006* (2013.01); *C21C 7/0075* (2013.01); *C21C 7/06* (2013.01); *C21C 7/10* (2013.01); *C21D 1/26* (2013.01); *C21D 6/004* (2013.01); *C21D 6/005* (2013.01); *C21D 6/008* (2013.01); *C21D 8/065* (2013.01); *C21D 9/02* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/14* (2013.01); *C22C 38/16* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/34* (2013.01); *C22C 38/40* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 8/06* (2013.01); *C21D 2211/004* (2013.01)

(56) References Cited

U.S. PATENT DOCUMENTS

| | | | | |
|---|---|---|---|---|
| 2008/0279714 | A1 | 11/2008 | Hashimura et al. | |
| 2013/0260164 | A1* | 10/2013 | Kato | C22C 38/26 428/544 |
| 2014/0241934 | A1* | 8/2014 | Morohoshi | C21D 9/46 420/83 |

FOREIGN PATENT DOCUMENTS

| | | | | |
|---|---|---|---|---|
| CN | 101001969 | A | | 7/2007 |
| CN | 101671792 | A | | 3/2010 |
| CN | 102416411 | A | | 4/2012 |
| CN | 102884216 | A | | 1/2013 |
| CN | 1764733 | A | | 3/2016 |
| JP | 05-311225 | | | 11/1993 |
| JP | 07-003398 | | | 1/1995 |
| JP | 0797659 | A | | 4/1995 |
| JP | 09-263820 | | | 10/1997 |
| JP | 11-279695 | | | 10/1999 |
| JP | 2003-73776 | A | | 3/2003 |
| JP | 2004211204 | A | | 7/2004 |
| JP | 2004-277777 | | | 10/2004 |
| JP | 2005-002421 | | | 1/2005 |
| JP | 2005002422 | A | | 1/2005 |
| JP | 2007254818 | A | * | 10/2007 |
| JP | 2008163458 | A | | 7/2008 |
| JP | 2009-263704 | | | 11/2009 |
| JP | 2011117009 | A | | 6/2011 |
| JP | 2012-144782 | A | | 8/2012 |
| JP | 2013-108171 | | | 6/2013 |
| KR | 10-2007-0005013 | A | | 1/2007 |
| WO | 2013024876 | A1 | | 2/2013 |
| WO | 2013024876 | A1 | | 3/2013 |

OTHER PUBLICATIONS

Notice of Allowance dated Aug. 5, 2014 issued in corresponding Japanese Application No. 2012232934 [with English Translation].

Office Action dated May 30, 2016 issued in related Chinese Application No. 201380075822.X.1 [Partial English Translation of Search Report].

Extended European Search Report dated Oct. 31, 2016, in European Patent Application No. 13883297.7.

Office Action dated May 30, 2016 issued in related Chinese Application No. 201380075822.X [Partial English Translation of Search Report].

Office Action issued in Korean Patent Application No. 10-2015-7030973, dated Mar. 6, 2017.

* cited by examiner

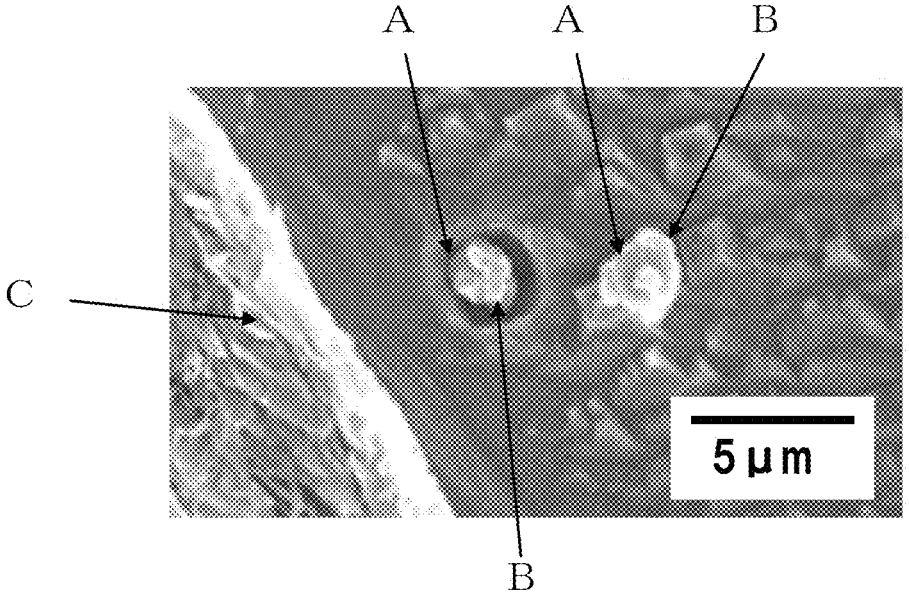
A
A
B
C
5 μm
B

SPRING STEEL WITH EXCELLENT FATIGUE RESISTANCE AND METHOD OF MANUFACTURING THE SAME

CROSS-REFERENCE TO RELATED APPLICATIONS

This application is a national stage application of International Application No. PCT/JP2013/061877, filed on Apr. 23, 2013, which is incorporated herein by reference in its entirety

TECHNICAL FIELD OF THE INVENTION

The present invention relates to steel for spring which is used as suspension device of automobile and the like, and to a method of manufacturing the same.

Particularly, the present invention relates to spring steel in which generation of a REM inclusion is controlled to remove a bad effect of a harmful inclusion such as alumina, TiN or MnS, and which has fatigue resistance, and to a method of manufacturing the same.

RELATED ART

Spring steel is used as a suspension springs for suspension device of automobile or the like, and high fatigue resistance is required to the spring steel.

Particularly demands for reducing the weight and improving the output of the automobile become higher so as to reduce the amount of exhaust gas and improve fuel consumption in recent years, and high stress design of suspension springs which are used for an engine or a suspension or the like has been desired.

Therefore, the spring steel is intended to increase strength and reduce wire diameter, and it is expected that load stress is increasing more and more.

Accordingly, the spring steel having high-performance in which fatigue strength is more improved and settling resistance is more excellent has been required.

One of the reasons that fatigue resistance and settling resistance of the spring steel are deteriorated is due to coarse inclusions (hereinafter, these are called inclusion) such as alumina and TiN of non-metallic hard inclusion or MnS, which are contained in the steel.

These inclusions easily become the origin in which stress is concentrated.

In addition, when a coating on a surface of a suspension spring is peeled off and then the exposed surface of the material is corroded, the fatigue strength of the suspension spring may be deteriorated due to the irruption of hydrogen into the steel from the moisture which is adhered to the exposed surface of the material.

In this case, the inclusions act as a hydrogen trap site, and then hydrogen is easily concentrated in the steel.

Therefore, an influence by inclusion itself and an influence by hydrogen are superimposed with each other. As a result, it causes the deterioration of fatigue strength.

From this viewpoint, it is needed that alumina, MnS and TiN which are contained in the steel are reduced as possible in order to improve the fatigue resistance and settling resistance of the spring steel.

Since dissolved oxygen in a large amount is included in molten steel refined by a converter or a vacuum processing vessel, this excessive oxygen is deoxidized by Al with a strong affinity with oxygen.

In addition, a ladle and the like are constructed by an alumina-based refractory in many cases.

Accordingly, even in a case of deoxidation by Si or Mn, not by Al, alumina that is the refractory is dissociated due to a reaction between molten steel and the refractory, and then, alumina is eluted as Al in molten steel.

Therefore, the eluted Al is re-oxidized and alumina is generated in the molten steel.

An alumina inclusion in the molten steel aggregates and integrates with each other, and can be easily clustered.

The clustered alumina inclusion remains in the products and brings an adverse effect on the fatigue strength.

Accordingly, in addition to the reduction of products obtained by deoxidation, reduction of inclusion and improvement of cleanliness are performed by a combination of (1) prevention of re-oxidation due to deaeration, slag reforming and the like, and (2) reduction of a mixed-in oxide-based inclusion caused by slag-cutting through the application of a secondary refining apparatus such as a RH degasser and a powder blowing apparatus in order to reduce and remove the alumina inclusion.

On the other hand, as disclosed in Patent Document 1, as a technique for refining an aluminum-based inclusion and removing the adverse effect, the method of reforming aluminum into spinel ($Al_2O_3$.MgO) or MgO by adding Mg alloy to the molten steel is known.

According to this method, coarsening of alumina due to agglutination can be prevented, and it is possible to avoid adverse effects of alumina for the steel quality.

However, in this method, softening the steel during hot rolling or friability of inclusions during drawing is not sufficient due to a crystalline phase in an oxide-based inclusion.

Therefore, miniaturization of inclusions is insufficient.

Patent Document 2, in addition to controlling an average composition of the $SiO_2$—$Al_2O_3$—CaO-based oxide having the thickness 2 μm or more in the longitudinal section of the longitudinal direction of steel wire rod to be $SiO_2$: 30 to 60%, $Al_2O_3$: 1 to 30% and CaO: 10 to 50%, and to controlling the melting point of the composite oxide to be 1400° C. or lower, preferably to be 1350° C. or lower, discloses that the oxide-based inclusion is dispersed finely by further including $B_2O_3$: 0.1 to 10% in the oxides, thereby remarkably improving the drawability and fatigue strength.

However, the addition of $B_2O_3$ is effective for suppressing crystallization of a CaO—$Al_2O_3$—$SiO_2$—$Mg_2O$-based oxide, but it cannot be said that the addition of $B_2O_3$ is useful for limiting or detoxifying TiN, MnS or alumina cluster which becomes a place where fatigue accumulates as a fracture initiation point in the spring steel.

In addition, with regard to manufacturing Al-killed steel that contains 0.005% by mass or more of acid-soluble Al, an alloy composed of two or more kinds of elements selected from Ca, Mg, and REM, and Al is added to the molten steel. Therefore, a method of manufacturing alumina cluster free Al-killed steel through adjusting the amount of $Al_2O_3$ in a generated inclusion to a range of 30 to 85 mass % is known.

For example, as disclosed in Patent Document 3, in a case of adding REM, an inclusion with a low melting point is formed by adding two or more kinds of elements selected from REM, Mg, and Ca so as to prevent generation of an alumina cluster.

Although this technique is effective at preventing sliver flaws, it is difficult to make the size of the inclusion small to a level that is demanded for the spring steel.

The reason is that inclusions with a low melting point aggregates and integrates with each other, and thus the inclusion tends to be relatively coarsened, when the inclusions with a low melting point is used.

Since the addition of REM of more than 0.010 mass % makes inclusion increase, rather than fatigue life is deteriorated. For example, as disclosed in Patent Document 4, it is known that it is necessary for limiting the addition of REM to 0.010 mass % or less.

However, Patent Document 4 does not disclose mechanism of this phenomenon, composition and state of inclusion.

In addition, when an inclusion made of a sulfide such as MnS is stretched by a process such as rolling, it may become a place where fatigue accumulates as a fracture initiation point, and deteriorate the fatigue resistance of the steel.

Accordingly, to improve the fatigue resistance, it is necessary to limit the sulfide which stretches.

In addition, as a method of preventing generation of a sulfide, a method in which Ca is added for desulfurization is known.

However, an Al—Ca—O that is formed due to addition of Ca has a problem in that it tends to be stretched, and tends to be a place where fatigue accumulates as a fracture initiation point.

In addition, since TiN is very hard, and crystallizes or precipitates in steel in a sharp shape, TiN becomes a place where fatigue accumulates and a fracture initiation point, and thus, an influence on the fatigue resistance is great.

For example, as disclosed in Patent Document 5, when the amount of Ti exceeds 0.001 mass %, the fatigue resistance deteriorate.

As a countermeasure thereof, it is important to adjust the amount of Ti to 0.001% by mass or less, but Ti is also contained in Si-alloy, and thus it is difficult to avoid mixing-in of Ti as an impurity.

In addition, it is necessary not to contain N in a molten steel, but this results in an increase in the costs of steelmaking, and is not realistic.

PRIOR ART DOCUMENT

Patent Document

[Patent Document 1] Japanese Unexamined Patent Application, First Publication No. H05-311225

[Patent Document 2] Japanese Unexamined Patent Application, First Publication No. 2009-263704

[Patent Document 3] Japanese Unexamined Patent Application, First Publication No. H09-263820

[Patent Document 4] Japanese Unexamined Patent Application, First Publication No. H11-279695

[Patent Document 5] Japanese Unexamined Patent Application, First Publication No. 2004-277777

DISCLOSURE OF THE INVENTION

Problems to be Solved by the Invention

An object of the invention is to provide spring steel with excellent fatigue resistance by detoxifying alumina, TiN and MnS which deteriorates fatigue resistance of the spring steel and a method of manufacturing the same.

Means for Solving the Problem

The gist of the invention is as follows.

(1) According to a first aspect of the invention, a spring steel includes as a chemical composition, by mass %: C: 0.4% to less than 0.9%, Si: 1.0% to 3.0%, Mn: 0.1% to 2.0%, Al: 0.01% to 0.05%, REM: 0.0001% to 0.005%, T.O: 0.0001% to 0.003%. Ti: less than 0.005%, N: 0.015% or less, P: 0.03% or less, S: 0.03% or less, Cr: 0% to 2.0%, Cu: 0% to 0.5%, Ni: 0% to 3.5%, Mo: 0% to 1.0%, W: 0% to 1.0%, B: 0% to 0.005%, V: 0% to 0.7%, Nb: 0% to 0.05%, Ca: 0% to 0.0020%, and the balance consists of Fe and impurities. The spring steel includes a composite inclusion having a maximum diameter of 2 μm or more that TiN is adhered to an inclusion containing REM, O and Al, in which a number of the composite inclusion is 0.004 pieces/mm$^2$ to 10 pieces/mm$^2$, the maximum diameter of the composite inclusion is 40 μm or less. The sum of the number density of an alumina cluster having the maximum diameter of 10 μm or more, MnS having a maximum diameter of 10 μm or more and TiN having a maximum diameter of 1 μm or more is 10 pieces/mm$^2$ or less.

(2) The spring steel according to (1) further includes as the chemical composition, one or more kinds of elements selected from the group consisting of, by mass %; Cr: 0.05% to 2.0%, Cu: 0.1% to 0.5%, Ni: 0.1% to 3.5%. Mo: 0.05% to 1.0%, W: 0.05% to 1.0%, B: 0.0005% to 0.005%, V: 0.05% to 0.7%, Nb: 0.005% to 0.05% and Ca: 0.0001% to 0.0020%.

(3) According to a second aspect of the invention, a method of manufacturing the spring steel according to (1), the method includes; a process of performing a deoxidation by using Al and then performing a deoxidation by using REM for 5 minutes or longer when a molten steel having the chemical composition according to (1) is refined in a ladle with vacuum degassing, a process of performing a circulation of the molten steel in a mold in a horizontal direction at 0.1 m/minute or faster when the molten steel is cast in the mold, and a process of performing a soaking treatment in which a cast piece obtained by casting is held at a temperature region of 1200° C. to 1250° C. for 60 seconds or longer and then blooming the cast piece.

(4) According to a third aspect of the invention, a spring includes the spring steel according to (1).

EFFECTS OF THE INVENTION

According to the aspects of the invention, in spring steel, an alumina is reformed into a REM-Al—O inclusion, and thus it is possible to prevent coarsening the alumina. In addition, S is fixed as a REM-Al—O—S inclusion, and thus and thus it is possible to limit generation of coarse MnS. Furthermore, TiN is adhered to the REM-Al—O inclusion or the REM-Al—O—S inclusion to form a composite inclusion, thereby reducing a number density of harmful TiN that is independently precipitated without adhesion to the inclusion. Accordingly, it is possible to provide spring steel with excellent fatigue resistance.

BRIEF DESCRIPTION OF THE DRAWINGS

FIG. 1 is a view showing an example of a composite inclusion observed in a spring steel according to the invention that TiN is compositely precipitated to a REM-Al—O inclusion.

EMBODIMENTS OF THE INVENTION

The present inventors have performed a thorough experiment and have made a thorough investigation to solve the problems in the related art.

As a result, the present inventors have obtained the following findings by adjusting the amount of REM in the spring steel and by controlling deoxidation process and a method of manufacturing the spring in order to suppress and control a form of harmful inclusion in the spring steel. When an alumina is reformed into an oxide containing REM, O and Al (hereinafter that may be cited "REM-Al—O"), it is possible to prevent coarsening of an oxide. When S is fixed as an oxysulfide containing REM, O, S and Al (hereinafter that may be cited "REM-Al—O—S"), it is possible to limit generation of coarse MnS. Furthermore, when TiN is conjugated to the REM-Al—O inclusion or the REM-Al—O—S inclusion, it is possible to reduce the number density of harmful TiN.

Hereinafter, spring steel and a method of manufacturing the same according to an embodiment of the invention made on the basis of the above-described findings will be described in detail.

First, a chemical composition of the spring steel according to this embodiment and the reason why the chemical composition is limited will be described.

In addition, % relating to the amount of each of the following elements represents mass %.

C: 0.4% or more and less than 0.9%

C is an effective element to secure strength.

However, when the amount of C is less than 0.4%, it is difficult to give a high strength to a final spring product.

On the other hand, when the amount of C is 0.9% or more, proeutectoid cementite is generated excessively in the cooling process after hot rolling, and thus, workability is remarkably deteriorated.

Therefore, the amount of C is set to 0.4% to less than 0.9%.

The amount of C is preferably 0.45% or more, and is more preferably 0.5% or more.

In addition, the amount of C is preferably 0.7% or less, and is more preferably 0.6% or less.

Si: 1.0% to 3.0%

Si is an element that increases hardenability and improves fatigue life, it is necessary for the steel to contain 1.0% or more of Si.

On the other hand, when the amount of Si exceeds 3.0%, the ductility of the ferrite phase in the pearlite is deteriorated.

Si has a function of improving settling resistance that is important in a spring. However, when the amount of Si exceeds 3.0%, the effect is saturated and the cost is not effective. In addition, decarburization is promoted.

Accordingly, the amount of Si is set to 1.0% to 3.0%.

The amount of Si is preferably 1.2% or more, and is more preferably 1.3% or more.

In addition, the amount of Si is preferably 2.0% or less, and is more preferably 1.9% or less.

Mn: 0.1% to 2.0%

Mn is an element effective for deoxidation and ensuring the strength, when the amount thereof is less than 0.1%, the effect is not exhibited.

On the other hand, when the amount of Mn exceeds 2.0%, segregation easily occurs and micro-martensite is generated in the segregated portion. Therefore, the workability and fatigue resistance are deteriorated.

Accordingly, the amount of Mn is set to 0.1% to 2.0%.

The amount of Mn is preferably 0.2% or more and is more preferably 0.3% or more.

In addition, the amount of Mn is preferably 1.5% or less, and is more preferably 1.4% or less.

REM: 0.0001% to 0.005%

REM is a strong desulfurizing and deoxidizing element, and plays a very important role in the spring steel according to this embodiment.

Here, REM is a general term of a total of 17 elements including 15 elements from lanthanum (atomic number: 57) to lutetium (atomic number: 71), and scandium (atomic number: 21), and yttrium (atomic number: 39).

First, REM reacts with alumina in the steel to separate O of alumina, thereby generating the REM-Al—O inclusion. Next, REM produces a REM-Al—O—S inclusion by absorbing S in steel.

Functions of REM in the spring steel according to this embodiment are as follows. REM reforms alumina into REM-Al—O containing REM, O, and Al, thereby preventing coarsening of an oxide.

REM fixes S through formation of REM-Al—O—S containing Al, REM, O, and S, and limits generation of coarse MnS.

In addition, TiN is compositely generated using the REM-Al—O or the REM-Al—O—S as a nucleus site, thereby forming an approximately spherical composite inclusion having a main structure of REM-Al—O—(TiN) or REM-Al—O—S—(TiN). The amount of precipitated TiN which is independently precipitated and has a hard and sharp square shape is deteriorated.

Here, (TiN) represents TiN adhering to a surface of the REM-Al—O or the REM-Al—O—S and forms a composite.

The composite inclusion having a main structure of REM-Al—O—(TiN) or REM-Al—O—S—(TiN) is different from TiN precipitate that is independently precipitated. For example, as shown in FIG. 1, since the composite inclusion has an approximately spherical shape, it is difficult for stress to concentrate around the composite inclusions.

In addition, the composite inclusion of REM-Al—O—(TiN) or REM-Al—O—S—(TiN) has a diameter of 1 to 5 μm, and is not stretched and coarsened, or clustered.

Therefore, since the composite inclusion does not become a fracture initiation point, the composite inclusion is not a harmless inclusion.

Here, for example, as shown in FIG. 1, the approximately spherical shape represents a shape in which a maximum height of surface unevenness is 0.5 μm or less and a value obtained by dividing the major axis of the inclusion by the minor axis of the inclusion is 3 or less.

In addition, the reason why TiN is compositely precipitated is assumed to be because a crystal lattice structure of TiN is similar to a crystal lattice structure of REM-Al—O or REM-Al—O—S at many points.

In addition, Ti is not contained in the REM-Al—O or in the REM-Al—O—S of the spring steel according to this embodiment as an oxide.

This is considered to be because T.O (total oxygen amount) in the spring steel according to this embodiment is low, and the amount of a Ti oxide generated is very small.

In addition, Ti is not contained in the inclusions as an oxide, and thus the crystal lattice structure of the REM-Al—O or the REM-Al—O—S and the crystal lattice structure of TiN become similar to each other.

Furthermore, REM has a function of preventing coarsening of an alumina cluster by reforming the alumina into the REM-Al—O by limiting aggregation and integration of the alumina.

To express the effect, the steel must contain a predetermined amount or more of REM so that it is necessary to reform the alumina into REM-Al—O.

In addition, it is necessary for the molten steel to contain a constant amount or more of REM based on the amount of S so that S is fixed by forming REM-Al—O—S inclusions.

The present inventors have made an examination from the above-described viewpoint, and they have experimentally found that when the steel contains less than 0.0001% of REM, the effect of REM that is contained in steel is insufficient.

Accordingly, the amount of REM is set to 0.0001% or more, preferably 0.0002% or more, more preferably 0.001% or more, and still more preferably 0.002% or more.

On the other hand, when the amount of REM is 0.005% or more, it is easy to contaminate a coarse inclusion into a product by falling off an unstable deposit from a refractory. Therefore, the fatigue strength of the product is deteriorated.

Accordingly, the amount of REM is set to 0.005% or less, preferably 0.004% or less, and more preferably 0.003% or less.

Al: 0.01% to 0.05%

Al is a deoxidizing element that reduces the total oxygen amount, and is an element that can be used to adjust the grain size of steel. Therefore, it is necessary for the steel to contain 0.01% or more, and is preferably 0.02% or more of Al.

However, when the amount of Al exceeds 0.05%, the effect of adjusting the grain size is saturated and a large number of alumina is remained. Therefore, that is not preferable.

T.O (total oxygen amount): 0.003% or less

O is an impurity element which is removed from steel by deoxidation, but some will always remain. O generates a composite inclusion having a main structure of REM-Al—O—TiN) or REM-Al—O—S—(TiN).

However, when the T.O becomes large, especially when the amount of O exceeds 0.003%, a large amount of an oxide such as alumina generates, and thus the fatigue life decreases. Accordingly, the upper limit of the amount of O is set to 0.0030%. In addition, the amount of O is preferably 0.0003% to 0.0025%.

In the spring steel according to this embodiment, it is necessary to limit Ti, N, P, and S, which are impurities, as follows.

Ti: less than 0.005%

Ti is an impurity which is contaminated from Si-alloy and forms coarse inclusions such as TiN having an angular shape.

The coarse inclusion tends to become a fracture initiation point and to act as a hydrogen trapping site, and thus, deteriorates fatigue resistance.

Therefore, it is very important to limit the generation of the coarse inclusion having an angular shape.

In the spring steel according to this embodiment, generation of isolated TiN which is harmful can be prevented, by compounding TiN with REM-Al—O or REM-Al—O—S.

As a result from the experimental studies, the amount of Ti is limited to less than 0.005% so as to prevent the generation of isolated TiN.

The amount of Ti is preferably 0.003% or less.

The amount of Ti includes 0%, but it is industrially difficult to stably reduce Ti. Therefore, the industrial lower limit of the amount of Ti is 0.0005%.

N: 0.015% or less

N is an impurity and forms a nitride and deteriorates the fatigue resistance. In addition, ductility and toughness are deteriorated due to strain aging.

When the amount of N exceeds 0.015%, a harmful result becomes significant, and thus, the amount of N is limited to 0.015% or less, is preferably 0.010% or less, and is more preferably 0.008% or less.

The amount of N includes 0%, but it is industrially difficult to stably reduce N. Therefore, the industrial lower limit of the amount of N is 0.002%.

P: 0.03% or less

P is an impurity and segregates at a grain boundary, and thus, decreases the fatigue life.

When the amount of P exceeds 0.03%, a decrease in the fatigue life becomes significant. Accordingly, the amount of P is limited to 0.03% or less, and is preferably 0.02% or less.

The amount of P includes 0%, but it is industrially difficult to stably reduce P. Therefore, the industrial lower limit of the amount of P is 0.001%.

S: 0.03% or less

S is an impurity and forms a sulfide.

When the amount of S exceeds 0.03%, S forms coarse MnS and decreases the fatigue life. Accordingly, the amount of S is limited to 0.03% or less, and is preferable 0.01% or less.

The amount of S includes 0%, but it is industrially difficult to stably reduce S. Therefore, the industrial lower limit of the amount of S is 0.001%.

The above-described components are included as a basic chemical composition of the spring steel according to this embodiment, and the balance consists of Fe and impurities.

In addition, "impurities" in the "the balance consists of Fe and impurities" represents ore or scrap as a raw material when steel is industrially manufactured, or a material that is mixed in due to the manufacturing environment and the like.

In addition to the above-described elements, the following elements may be selectively contained. Hereinafter, a selective element will be described.

The spring steel according to this embodiment may contain one or more kind of 2.0% or less of Cr, 0.5% or less of Cu, 3.5% or less of Ni, 1.0% or less of Mo, 1.0% or less of W, and 0.005% or less of B.

Cr: 2.0% or less

Cr is an effective element that increases the strength, and increases the hardenability and improves the fatigue life.

In a case where the hardenability and temper softening resistance are needed and 0.05% or more of Cr is contained, it is possible to stably express this effect.

Especially, to obtain excellent temper softening resistance, it is necessary for the steel to contain 0.5% or more of Cr, and is preferably 0.7% or more of Cr.

However, when the amount of Cr exceeds 2.0%, the hardness of the steel is increased, and thus the cold workability decreases. Accordingly, the amount of Cr is set to 2.0% or less.

Specially, in the case of cold-coiling, the amount of Cr is preferably 1.5% or more so as to improve the stability in the cold-coiling.

Cu: 0.50% or less

Cu has an influence on the hardenability, moreover, is an element which effects corrosion resistance and limits decarburization.

When the amount of Cu is 0.1% or more, and is preferably 0.2% or more, the effect of limiting decarburization and corrosion is expressed.

However, when the amount of Cu is large, hot-ductility is deteriorated, and thus, cracks and flaws are occurred in the manufacturing process of casting, rolling or forging. Therefore, the amount of Cu is 0.5% or less, and is preferably 0.3% or less.

The deterioration in the hot-ductility due to Cu, as described below, can be relieved by containing Ni. Then, when the amount of Cu≤the amount of Ni, the deterioration in the hot-ductility can be suppressed and thus high quality can be maintained.

Ni: 3.5% or less

Ni is an element that improves the strength and the hardenability of steel. When the amount of Ni is 0.1% or more, the effect is expressed.

Ni has an influence on the amount of retained austenite after quenching too. When the amount of Ni exceeds 3.5%, the amount of the retained austenite becomes large, and thus, there is a case in which the performance of the spring is insufficient due to retention softness after quenching.

Accordingly, when the amount of Ni exceeds 3.5%, and thus, instability of the materials for product is led and the amount of Ni is set to 3.5% or less.

In addition, Ni is an expensive element, and is preferably limited from the view point of manufacturing cost.

From the view point of the retained austenite and the hardenability, the amount of Ni is preferably 2.5% or less, and is more preferably 1.0% or less.

When Cu is contained in the steel, Ni has an effect for suppressing the adverse effect due to Cu.

That is, Cu is an element that deteriorates the hot-ductility in the steel, and thus, cracks and flaws are sometimes occurred in the hot-rolling or hot-forging.

However, when Ni is contained, Ni forms an alloy phase with Cu and hot-ductility is limited.

In the case where Cu is mixed in the steel, the amount of Ni is preferably 0.1% or more, and is more preferably 0.2% or more.

In addition, the amount of Cu≤the amount of Ni is preferable in the relationship with Cu.

Mo: 1.0% or less

Mo is an effective element for improving the hardenability and the temper softening resistance.

Specially, to improve the temper softening resistance, the amount of Mo is set to 0.05% or more. Mo is an element that forms Mo-based carbide in the steel.

The temperature in which Mo-based carbide is precipitated is lower than V-based carbide thereof. Then, it is effective element for the spring steel having high-strength tempered in the relatively low temperature.

When the amount of Mo is 0.05% or more and this effect is expressed. The amount of Mo is preferably 0.1% or more.

On the other hand, when the amount of Mo exceeds 1.0%, it is easy to form supercooling structure during cooling in the heat treatment before working or hot-rolling.

The amount of Mo is set to 1.0% or less, preferably 0.75% or less so as to suppress the generation of the supercooling structure that causes delayed cracks or cracks during working.

In addition, when it is focused on ensuring production stability by limiting variation in quality during manufacturing the spring, the amount of Mo is preferably 0.5% or less.

Furthermore, the amount of Mo is preferably 0.3% or less so as to stabilize shape accuracy by precisely controlling temperature variation-transformation strain during cooling.

W: 1.00 or less

As with Mo, W is an effective element for improving the hardenability and the temper softening resistance and is an element that precipitates as carbide in the steel.

Specially, the amount of W is set to 0.05% or more, is preferably 0.1% or more so as to improve the temper softening resistance.

On the other hand, when the amount of W exceeds 1.0%, it is easy to form supercooling structure during cooling in the heat treatment before working or hot-rolling.

The amount of W is set to 1.0% or less, preferably 0.75% or less so as to limit the generation of the supercooling structure that causes delayed cracks or cracks during working.

B: 0.005% or less

B is an element for improving the hardenability of the steel by adding the small amount of B.

In addition, in a case where a base metal is high carbon material, B forms boron-iron carbide in the cooling process after hot-rolling and increases growth rate of ferrite, and thus, promotes softening the steel.

Furthermore, when 0.0005% or more of B is contained in the steel, B suppresses the segregation of P by segregating at grain boundary of austenite, and thus, B contributes to an improvement in the fatigue resistance and impact strength due to strengthening grain boundary.

However, when the amount of B exceeds 0.005%, the effect is saturated. Then it is easy to form supercooling structure such as martensite or bainite during manufacturing such as casting, hot-rolling and forging, and thus, manufacturability of product and impact strength may be deteriorated. Therefore, the amount of B is set to 0.005% or less, and more preferably 0.003% or less.

The spring steel according to this embodiment may contain one or more kind of 0.7% or less of V and 0.05% or less of Nb, by mass %.

V: 0.7% or less

V is an element that is coupled to C and N in steel to form a nitride, a carbide or a carbonitride. Usually, V becomes a minute nitride, a minute carbide or a minute carbonitride of V having a circle equivalent diameter of less than 0.2 μm, and thus, it is effective for improving the temper softening resistance, raising the yield point and refining prior austenite.

When V is sufficiently precipitated in the steel by tempering, hardness and tensile strength can be improved, and thus, V is set to a selected element that is contained as necessary.

To attain these effects, the amount of V is set to 0.05% or more, preferably 0.06% or more.

On the other hand, when the amount of V exceeds 0.7%, carbide and carbonitrides is not sufficiently soluted in the heating before quenching and remain as coarse spherical carbide, that is, undissolved carbides. Therefore, since the workability and the fatigue resistance are deteriorated, the amount of V is set to 0.7% or less.

When V is contained excessively, since it is easy to form a supercooling structure that causes cracks or breaking before working, it is preferable that the amount of V is 0.5% or less.

When it focuses on ensuring production stability by suppressing variation in quality during manufacturing the spring, the amount of V is preferably 0.3% or less.

In addition, since V is an element that has large influence on the generation of the retained austenite, it is necessary to precisely control the amount of V.

Accordingly, in a case where other elements that improve the hardenability are contained, for example, one or more kinds of Mn, Ni, Mo and W is contained, and the amount of V is preferably 0.25% or less.

Nb: less than 0.05%

Nb is an element that is coupled to C and N in steel to form a nitride, a carbide or a carbonitride.

Compared to a case where Nb is not contained in the steel, even the amount of Nb is small, so it is very effective for limiting the generation of coarse grain.

These effects are expressed when the amount of Nb is set to 0.005% or more.

However, Nb is an element that deteriorates the hot-ductility. When Nb is contained excessively, Nb causes cracks during casting, rolling and forging, and thus, manufacturability is much deteriorated.

Therefore, the amount of Nb is set to 0.05% or less.

Furthermore, in a case where it focuses on the workability such as the cold coilability, the amount of Nb is less than 0.03%, and is preferably less than 0.02%.

The spring steel according to this embodiment may contain 0.0020% or less of Ca, by mass %.

Ca: 0.0020% or less

Ca has a strong desulfurizing effect and is effective for limiting the generation of MnS. Accordingly, 0.0001% or more of Ca may be contained for the purpose of desulfurization.

However, Ca is absorbed into REM-Al—O inclusion or REM-Al—O—S inclusion in the steel and forms REM-Ca—Al—O—S or REM-Ca—Al—O—S.

Compared to REM-Al—O and REM-Al—O—S, REM-Ca—Al—O and REM-Ca—Al—O—S tends to increase the size thereof, in the case where the oxide in which the amount of oxygen is large is the main inclusion in the inclusions. Furthermore, since REM-Ca—Al—O and REM-Ca—Al—O—S deteriorates the ability in which TiN is compositely precipitated, from the view point of removing the adverse effect, the amount of Ca is preferably small.

The reason is assumed that REM-Ca—Al—O and REM-Ca—Al—O—S is inferior to REM-Al—O and REM-Al—O—S with respect to the similarity in the crystal lattice structure with TiN.

In addition, when the amount of Ca exceeds 0.0020% in the steel, many Al—Ca—O oxides having a low melting point are generated and become coarse inclusions due to stretching by rolling. Therefore, the place coarse inclusions become places where fatigue accumulates or fractures start.

Accordingly, Ca is a selected element and the amount of Ca is set to 0.0001% to 0.0020%.

Next, influences on the fatigue life due to the inclusions will be described as follows.

The inventors obtained the findings as below through the experimental studies.

(1) As shown in FIG. 1, since 0.004 pieces/mm$^2$ or more of the composite inclusions having a maximum diameter of 2 μm that TiN is adhered to the inclusions containing REM, O and Al, or the inclusions containing REM, O, S and Al, are contained, the generation of isolated TiN that is independently precipitated is limited, and thus, the fatigue life can be improved.

(2) However, when the composite inclusions having a circle equivalent diameter of more than 10 μm are observed, even the composite inclusions tend to deteriorate the fatigue strength.

(3) In addition, when the total of isolated inclusions (a), (b) and (c) that is separated from the above composite inclusions and has a negative effect, which is equivalent to each other, on the fatigue life is 10 pieces/mm$^2$ or less, the excellent fatigue life can be obtained.

(a) MnS having a maximum diameter of 10 μm or more (Stretched MnS)

(b) Alumina cluster having a maximum diameter of 10 μm or more (c) TiN having a maximum diameter of 1 μm or more (isolated TiN)

Since alumina is reformed into REM-Al—O in the spring steel according to this embodiment, the generation of alumina cluster which is harmful for fatigue resistance is limited.

In addition, since S is fixed as REM-Al—O—S, the generation of MnS that is stretched and deteriorates the fatigue resistance, and the like.

Furthermore, for example, as shown in FIG. 1, since TiN is conjugated to REM-Al—O—S and an approximately spherical composite inclusion having a main structure of REM-Al—O—S—(TiN) is formed, the generation of TiN that is independently precipitated and has an adverse effect on the fatigue life is limited.

As a result, the total number density of (a) MnS having a maximum diameter of 10 μm or more (Stretched MnS), (b) Alumina cluster having a maximum diameter of 10 μm or more and (c) TiN having a maximum diameter of 1 μm or more (isolated TiN) is limited to be 10 pieces/mm$^2$ or less. Therefore, the fatigue life can be improved.

A method of manufacturing the spring steel according to this embodiment will be described.

When molten steel for the spring steel according to this embodiment is refined, a sequence of adding a deoxidizing agent and the deoxidation time are important.

In this manufacturing method, first, deoxidation is performed by using Al and T.O (total oxygen amount) is set to 0.003% or less.

Then, deoxidation is performed for 5 minutes or longer by using REM, and then ladle refining including vacuum degassing is performed.

Prior to deoxidation with REM, when deoxidation is performed by using an element other than Al, it is difficult to stably reduce an amount of oxygen. In addition, after deoxidizing by using Al, deoxidation is performed by using REM, and the composite inclusions that TiN is adhered to REM-Al—O or REM-Al—O—S tends to be generated.

In addition, when deoxidation time is shorter than 5 minutes after adding REM, alumina cannot be sufficiently reformed.

In this manufacturing method, the deoxidizing agent is added in the above order and REM-Al—O inclusion is generated, and thus, the generation of harmful alumina is limited.

For the REM added, a misch metal (alloy composed of a plurality of rare-earth metals) and the like may be used, and for example, an aggregated misch metal may be added to molten steel.

In addition, at the end of the refining, Ca—Si alloy or flux such as CaO—$CaF_2$ can be added to approximately perform desulfurization by Ca.

The specific gravity of REM-Al—O or REM-Al—O—S generated by deoxidation in the molten steel that refined by ladle is 6 and is close to a specific gravity of 7 of steel, and thus floating and separation are less likely to occur.

Therefore, when pouring molten steel into a mold, the REM-Al—O or REM-Al—O—S penetrates up to a deep position of unsolidified layer of a cast piece due to a downward flow, and thus REM-Al—O or REM-Al—O—S tends to segregate at the central portion of the cast piece.

When REM-Al—O or REM-Al—O—S segregates at the central portion of the cast piece, REM-Al—O or REM-Al—O—S is deficient in a surface layer portion of the cast piece. Therefore, it is difficult to generate a composite inclusion by adhering TiN to the REM-Al—O or REM-Al—O—S.

Accordingly, a detoxifying effect of TiN is weakened at a surface layer portion of a product.

Accordingly in this manufacturing method, to prevent segregation of the REM-Al—O and REM-Al—O—S, molten steel is stirred and circulated in the mold in a horizontal direction to realize uniform dispersion of the inclusions.

The circulation of the molten steel inside the mold is performed at a flow rate of 0.1 m/minute or faster so as to realize further uniform dispersion of REM-Al—O and REM-Al—O—S in this manufacturing method.

When the circulation speed inside the mold is slower than 0.1 m/minute, REM-Al—O and REM-Al—O—S are less likely to be uniformly dispersed.

As stirring means, for example, an electromagnetic force and the like may be applied.

Next, soaking treatment is performed to the cast steel, and then, blooming is performed.

The cast piece is held at a temperature region of 1250° C. to 1200° C. for 60 seconds or more to obtain the above-described composite inclusion in the soaking treatment.

This temperature region is a temperature region at which a composite precipitation of TiN with respect to REM-Al—O and REM-Al—O—S are started. TiN is allowed to sufficiently grow at the surface of REM-Al—O and REM-Al—O—S in this temperature region. To limit the generation of isolated TiN that is independently precipitated, it is necessary to be hold the cast piece at a temperature region of 1250° C. to 1200° C. for 60 seconds or more.

The present inventors obtained the knowledge through experimental studies.

In addition, typically, when the cast piece is heated at a temperature region of 1250° C. to 1200° C., TiN is solid-soluted.

However, in the spring steel according to this embodiment the amount of C is 0.4% to 0.9%, and is high. Many cementite are existed in the spring steel and solubility of N in the cementite is low, and thus, it is assumed that TiN is precipitated and grows at the surface of REM-Al—O and REM-Al—O—S.

Two kinds of hot forming method and cold forming method are used as forming method of the spring.

In the hot forming method, after the wire rod is manufactured by blooming and wire rolling, the steel wire is manufactured by small wire drawing so as to adjust the roundness. Then, after the steel wire is heated and hot-formed into the spring shape at 900° C. to 1050° C., the strength is adjusted by quenching at 850° C. to 950° C. and by tempering at 420° C. to 500° C. in the heat treatment.

On the other hand, in the cold forming method, after the wire rod is manufactured by blooming and wire rolling, the steel wire is manufactured by small wire drawing so as to adjust the roundness. Before the steel wire is formed into the spring shape, the steel wire is heated and the strength of the steel wire is adjusted by quenching at 850° C. to 950° C. and by tempering at 420° C. to 500° C. in the heat treatment. Then, the steel wire is formed into the spring shape in room temperature.

Thereafter, shot peening is performed as necessary. In addition, it is subjected to plating or resin coating on the surface of the steel wire, and products are manufactured.

EXAMPLE

Next, examples of the invention will be described, but conditions in the examples are conditional examples that are employed to confirm applicability and an effect of the invention and the invention is not limited to the conditional examples.

The invention can employ various conditions as long as the object of the invention is achieved without departing from the gist of the invention.

During the vacuum degassing in the ladle refining, refining was performed under conditions shown in Table 1 by using metal Al, a misch metal, Ca—Si alloy and a flux of $CaO:CaF_2$=50:50 (mass ratio) to obtain molten steel having a chemical composition shown in Table 2 and Table 3. The molten steel was cast to a 300 mm square cast piece by using a continuous casting apparatus.

At that time, circulation inside a mold was performed by electromagnetic agitation under conditions shown in Table 1, thereby manufacturing a bloom.

The bloom was heated at 1200° C. to 1250° C. for a time as shown in Table 1 and blooming was performed to manufacture a billet, and billet having a size of 160 mm×160 mm was manufactured. The billet was reheated at 1100° C., and steel bar having a diameter of 15 mm was obtained by bar-rolling.

Furthermore, quenching at 900° C. for 20 minutes and tempering heat treatment at 450° C. for 20 minutes were performed to the sample cut from the bar steel and water cooling was performed, and thus, hardness of wire rod was adjusted 480 HV to 520 HV by Vickers hardness.

Thereafter, No. 1 test specimen (total length; 80 mm, grip length; 20 mm, grip diameter $D_0$=12 mm, parallel portion diameter d=6 mm, parallel portion length=10 mm) for Method of Rotating Bending Fatigue Testing of Metals of JIS Z2274 (1978) was fabricated by finish machining.

In addition, electrolytic charging was performed in the an aqueous solution of 3% NaCl+0.3% ammonium thiocyanate as the test specimen being a cathode, thereby, 0.2 to 0.5 ppm of the hydrogen was included in the steel.

After charging, hydrogen was filled in the test specimen by performing Zn-coating. Then, rotating bending fatigue test was performed to the test specimen using Ono-type rotating bending fatigue testing machine by applying both pretend stress repeated stress according to JIS Z2273 (1978), and load stress at the fatigue limit up to $5\times10^5$ was evaluated.

In addition, with regard to the above-described sample, a cross-section in a stretching direction thereof was mirror-polished, and was processed with selective potentiostatic etching by an electrolytic dissolution method (SPEED method). Then, measurement with a scanning electron microscope was performed with respect to inclusions in steel in a range of 2 mm width in a radial direction which centers around a depth of the half of a radius from a surface, and a length of 5 mm in a rolling direction, a composition of the inclusion was analyzed using EDX, and inclusions in 10 $mm^2$ of the sample were counted to measure the number density.

TABLE 1

| | Order of adding alloy | Reflux time after adding REM (minute) | Circulation flow rate of molten steel inside mold (mpm) | Holding time at 1250° C. to 1200° C. (second) |
|---|---|---|---|---|
| Example 1 | Al→REM | 6 | 0.2 | 150 |
| Example 2 | Al→REM | 6 | 0.2 | 70 |
| Example 3 | Al→REM | 6 | 0.25 | 120 |
| Example 4 | Al→REM | 8 | 0.15 | 120 |
| Example 5 | Al→REM | 8 | 0.35 | 120 |
| Example 6 | Al→REM | 8 | 0.3 | 80 |
| Example 7 | Al→REM | 8 | 0.2 | 120 |
| Example 8 | Al→REM | 8 | 0.2 | 120 |
| Example 9 | Al→REM | 10 | 0.25 | 120 |
| Example 10 | Al→REM | 8 | 0.2 | 120 |
| Example 11 | Al→REM | 8 | 0.2 | 120 |
| Example 12 | Al→REM→Ca | 8 | 0.2 | 120 |
| Example 13 | Al→REM | 8 | 0.2 | 120 |
| Example 14 | Al→REM | 8 | 0.2 | 120 |
| Example 15 | Al→REM | 8 | 0.2 | 120 |
| Example 16 | Al→REM | 8 | 0.2 | 120 |
| Example 17 | Al→REM | 8 | 0.2 | 120 |
| Example 18 | Al→REM | 8 | 0.2 | 120 |
| Example 19 | Al→REM | 8 | 0.2 | 120 |
| Example 20 | Al→REM | 8 | 0.2 | 120 |
| Example 21 | Al→REM | 8 | 0.2 | 120 |
| Example 22 | Al→REM→※ | 8 | 0.2 | 120 |
| Example 23 | Al→REM→※ | 8 | 0.2 | 120 |
| Example 24 | Al→REM | 8 | 0.15 | 120 |
| Example 25 | Al→REM→Ca | 8 | 0.2 | 120 |
| Example 26 | Al→REM | 8 | 0.2 | 120 |
| Example 27 | Al→REM | 8 | 0.2 | 120 |
| Example 28 | Al→REM | 8 | 0.2 | 120 |
| Comparative example 1 | Al | 6 | 0.2 | 120 |
| Comparative example 2 | Al→REM | 6 | 0.2 | 120 |
| Comparative example 3 | Al→REM | 6 | 0.2 | 150 |
| Comparative example 4 | Al→REM | 3 | 0.2 | 80 |
| Comparative example 5 | Al→REM | 6 | 0.05 | 120 |
| Comparative example 6 | Al→REM | 6 | 0.2 | 45 |
| Comparative example 7 | Al→REM | 6 | 0.2 | 120 |

※represents that flux containing CaO was blown.

TABLE 2

| | C mass % | Si mass % | Mn mass % | Al mass % | REM mass % | T.O mass % | Ti mass % | N mass % | P mass % | S mass % |
|---|---|---|---|---|---|---|---|---|---|---|
| Example 1 | 0.42 | 1.86 | 0.83 | 0.034 | 0.0025 | 0.0013 | 0.003 | 0.0045 | 0.013 | 0.006 |
| Example 2 | 0.49 | 1.44 | 0.90 | 0.038 | 0.0049 | 0.0014 | 0.002 | 0.0063 | 0.014 | 0.009 |
| Example 3 | 0.53 | 1.45 | 0.88 | 0.026 | 0.0042 | 0.0011 | 0.003 | 0.0074 | 0.011 | 0.008 |
| Example 4 | 0.41 | 2.02 | 0.67 | 0.018 | 0.0020 | 0.0010 | 0.002 | 0.0052 | 0.014 | 0.009 |
| Example 5 | 0.57 | 1.79 | 0.89 | 0.039 | 0.0019 | 0.0008 | 0.001 | 0.0065 | 0.012 | 0.007 |
| Example 6 | 0.52 | 1.68 | 0.62 | 0.017 | 0.0028 | 0.0012 | 0.002 | 0.0069 | 0.011 | 0.006 |
| Example 7 | 0.57 | 1.48 | 0.60 | 0.028 | 0.0037 | 0.0010 | 0.003 | 0.0059 | 0.013 | 0.007 |
| Example 8 | 0.40 | 1.72 | 0.71 | 0.038 | 0.0016 | 0.0012 | 0.001 | 0.0057 | 0.015 | 0.008 |
| Example 9 | 0.50 | 1.34 | 0.60 | 0.022 | 0.0028 | 0.0010 | 0.003 | 0.0071 | 0.011 | 0.005 |
| Example 10 | 0.46 | 2.12 | 1.03 | 0.031 | 0.0025 | 0.0011 | 0.002 | 0.0043 | 0.015 | 0.006 |
| Example 11 | 0.52 | 1.34 | 0.82 | 0.021 | 0.0024 | 0.0008 | 0.001 | 0.0075 | 0.013 | 0.008 |
| Example 12 | 0.44 | 1.41 | 0.85 | 0.027 | 0.0028 | 0.0012 | 0.002 | 0.0070 | 0.014 | 0.006 |
| Example 13 | 0.49 | 2.06 | 0.62 | 0.025 | 0.0037 | 0.0015 | 0.001 | 0.0061 | 0.013 | 0.009 |
| Example 14 | 0.50 | 1.76 | 0.77 | 0.039 | 0.0009 | 0.0006 | 0.003 | 0.0079 | 0.014 | 0.008 |
| Example 15 | 0.43 | 1.92 | 0.70 | 0.031 | 0.0039 | 0.0006 | 0.002 | 0.0060 | 0.012 | 0.009 |
| Example 16 | 0.54 | 2.48 | 0.74 | 0.021 | 0.0024 | 0.0006 | 0.002 | 0.0053 | 0.014 | 0.008 |
| Example 17 | 0.48 | 2.04 | 0.76 | 0.027 | 0.0030 | 0.0005 | 0.003 | 0.0076 | 0.011 | 0.006 |
| Example 18 | 0.43 | 2.00 | 0.61 | 0.032 | 0.0026 | 0.0013 | 0.002 | 0.0070 | 0.014 | 0.007 |
| Example 19 | 0.55 | 2.10 | 0.77 | 0.019 | 0.0026 | 0.0015 | 0.002 | 0.0046 | 0.014 | 0.007 |
| Example 20 | 0.49 | 1.47 | 0.86 | 0.028 | 0.0028 | 0.0008 | 0.001 | 0.0071 | 0.014 | 0.007 |
| Example 21 | 0.58 | 1.65 | 0.67 | 0.025 | 0.0031 | 0.0007 | 0.002 | 0.0049 | 0.010 | 0.005 |
| Example 22 | 0.49 | 2.42 | 0.88 | 0.035 | 0.0015 | 0.0012 | 0.002 | 0.0042 | 0.012 | 0.006 |
| Example 23 | 0.58 | 1.58 | 0.86 | 0.022 | 0.0007 | 0.0007 | 0.001 | 0.0070 | 0.011 | 0.009 |
| Example 24 | 0.41 | 2.02 | 0.67 | 0.018 | 0.0002 | 0.0010 | 0.002 | 0.0052 | 0.014 | 0.009 |
| Example 25 | 0.56 | 2.13 | 1.05 | 0.025 | 0.0002 | 0.0014 | 0.002 | 0.0051 | 0.011 | 0.009 |
| Example 26 | 0.58 | 1.91 | 0.76 | 0.034 | 0.0013 | 0.0011 | 0.002 | 0.0063 | 0.014 | 0.008 |
| Example 27 | 0.49 | 2.15 | 0.62 | 0.020 | 0.0005 | 0.0008 | 0.002 | 0.0077 | 0.013 | 0.006 |
| Example 28 | 0.55 | 1.83 | 0.87 | 0.019 | 0.0005 | 0.0008 | 0.001 | 0.0078 | 0.012 | 0.006 |
| Comparative example 1 | 0.51 | 1.51 | 0.61 | 0.033 | | 0.0013 | 0.001 | 0.0064 | 0.015 | 0.006 |

TABLE 2-continued

| | C mass % | Si mass % | Mn mass % | Al mass % | REM mass % | T.O mass % | Ti mass % | N mass % | P mass % | S mass % |
|---|---|---|---|---|---|---|---|---|---|---|
| Comparative example 2 | 0.54 | 1.67 | 0.68 | 0.021 | <0.0001 | 0.0005 | 0.003 | 0.0070 | 0.014 | 0.006 |
| Comparative example 3 | 0.55 | 1.65 | 0.69 | 0.027 | 0.0044 | 0.0008 | 0.003 | 0.0051 | 0.014 | 0.035 |
| Comparative example 4 | 0.56 | 2.20 | 0.86 | 0.038 | 0.0042 | 0.0007 | 0.002 | 0.0050 | 0.014 | 0.009 |
| Comparative example 5 | 0.53 | 1.49 | 0.78 | 0.021 | 0.0052 | 0.0005 | 0.001 | 0.0041 | 0.014 | 0.005 |
| Comparative example 6 | 0.47 | 1.60 | 0.80 | 0.018 | 0.0063 | 0.0008 | 0.003 | 0.0069 | 0.013 | 0.005 |
| Comparative example 7 | 0.53 | 1.81 | 0.73 | 0.032 | 0.0055 | 0.0009 | 0.001 | 0.0044 | 0.015 | 0.007 |

TABLE 3

| | Cr mass % | Cu mass % | B mass % | W mass % | V mass % | Mo mass % | Ni mass % | Nb mass % | Ca mass % |
|---|---|---|---|---|---|---|---|---|---|
| Example 1 | 0.98 | | | | | | | | |
| Example 2 | 0.92 | | | | | | | | |
| Example 3 | 0.62 | | | | | | | | |
| Example 4 | 0.94 | | | | | | | | |
| Example 5 | 0.69 | | | | | | | | |
| Example 6 | 0.62 | | | | | | | | |
| Example 7 | 0.88 | | | | | | | | |
| Example 8 | 0.92 | | | | | | | | |
| Example 9 | 0.82 | | | | | | | | |
| Example 10 | | | | | | | | | |
| Example 11 | 0.97 | | | | | | | | |
| Example 12 | 0.90 | | | | | | | | 0.0010 |
| Example 13 | 0.78 | | | | 0.24 | | | | |
| Example 14 | 0.67 | | | | | | 1.65 | | |
| Example 15 | 0.79 | 0.23 | | | | | | | |
| Example 16 | 0.65 | 0.22 | | | | | 1.70 | | |
| Example 17 | 0.90 | | | | 0.22 | 0.26 | | | |
| Example 18 | 0.62 | | | | 0.22 | | | 0.027 | |
| Example 19 | | | | | | | 1.68 | | |
| Example 20 | 0.96 | | | | 0.25 | | 1.65 | | |
| Example 21 | | 0.23 | | | | | 1.68 | | |
| Example 22 | 0.68 | | | | 0.20 | | | | 0.0005 |
| Example 23 | 0.98 | | | | | | | | 0.0005 |
| Example 24 | 0.94 | | | | | | | | |
| Example 25 | | | | | | | | | 0.0007 |
| Example 26 | 0.94 | 0.15 | 0.0019 | 0.11 | 0.15 | 0.08 | 0.17 | 0.017 | |
| Example 27 | 0.74 | | | 0.22 | | | | | |
| Example 28 | 0.67 | | 0.0018 | | | | | | |
| Comparative example 1 | 0.74 | | 0.0029 | | | | | | |
| Comparative example 2 | 0.85 | | | | | | | | |
| Comparative example 3 | 0.94 | | 0.0030 | | | | | | |
| Comparative example 4 | 0.80 | | 0.0032 | | | | | | |
| Comparative example 5 | 0.85 | | 0.0033 | | | | | | |
| Comparative example 6 | 0.91 | | 0.0032 | | | | | | |
| Comparative example 7 | 0.81 | | | | | | | | |

TABLE 4

| | Casting results | State of oxide | Number density of composite inclusion (pieces/mm$^2$) | Maximum circle equivalent diameter of inclusion (μm) | Number density of $Al_2O_3$ + MnS + TiN (pieces/mm$^2$) | Fatigue strength (MPa) | Hardness by tempering at 450° C. (HV) |
|---|---|---|---|---|---|---|---|
| Example 1 | Completed | REM-Al—O—(TiN) | 3.1 | 22 | 7.9 | 718 | 496 |
| Example 2 | Completed | REM-Al—O—S—(TiN) | 5.7 | 27 | 3.2 | 711 | 509 |
| Example 3 | Completed | REM-Al—O—S—(TiN) | 5.2 | 29 | 5.3 | 715 | 508 |
| Example 4 | Completed | REM-Al—O—S—(TiN) | 3.1 | 29 | 4.9 | 694 | 488 |
| Example 5 | Completed | REM-Al—O—S—(TiN) | 2.2 | 19 | 6.6 | 706 | 490 |
| Example 6 | Completed | REM-Al—O—(TiN) | 3.9 | 24 | 7.1 | 703 | 507 |
| Example 7 | Completed | REM-Al—O—S—(TiN) | 6.0 | 30 | 7.4 | 715 | 505 |
| Example 8 | Completed | REM-Al—O—S—(TiN) | 2.0 | 20 | 4.1 | 681 | 497 |
| Example 9 | Completed | REM-Al—O—(TiN) | 4.2 | 28 | 4.4 | 705 | 485 |
| Example 10 | Completed | REM-Al—O—(TiN) | 4.0 | 27 | 2.6 | 707 | 500 |
| Example 11 | Completed | REM-Al—O—S—(TiN) | 3.0 | 28 | 6.0 | 682 | 500 |
| Example 12 | Completed | REM-Ca—Al—O—(TiN) | 3.5 | 35 | 7.4 | 711 | 506 |

TABLE 4-continued

| | Casting results | State of oxide | Number density of composite inclusion (pieces/mm$^2$) | Maximum circle equivalent diameter of inclusion (μm) | Number density of $Al_2O_3$ + MnS + TiN (pieces/mm$^2$) | Fatigue strength (MPa) | Hardness by tempering at 450° C. (HV) |
|---|---|---|---|---|---|---|---|
| Example 13 | Completed | REM-Al—O—S—(TiN) | 5.3 | 35 | 7.7 | 722 | 528 |
| Example 14 | Completed | REM-Al—O—S—(TiN) | 1.2 | 19 | 2.7 | 755 | 518 |
| Example 15 | Completed | REM-Al—O—S—(TiN) | 5.5 | 27 | 7.2 | 725 | 527 |
| Example 16 | Completed | REM-Al—O—S—(TiN) | 3.0 | 31 | 6.9 | 762 | 512 |
| Example 17 | Completed | REM-Al—O—S—(TiN) | 3.3 | 22 | 4.8 | 759 | 518 |
| Example 18 | Completed | REM-Al—O—S—(TiN) | 3.0 | 31 | 7.2 | 738 | 523 |
| Example 19 | Completed | REM-Al—O—S—(TiN) | 3.9 | 27 | 7.9 | 753 | 529 |
| Example 20 | Completed | REM-Al—O—S—(TiN) | 3.6 | 19 | 5.4 | 763 | 520 |
| Example 21 | Completed | REM-Al—O—S—(TiN) | 5.1 | 19 | 2.8 | 761 | 518 |
| Example 22 | Completed | REM-Ca—Al—O—(TiN) | 2.1 | 38 | 2.7 | 763 | 534 |
| Example 23 | Completed | REM-Ca—Al—O—S—(TiN) | 0.9 | 34 | 5.4 | 727 | 513 |
| Example 24 | Completed | REM-Al—O—S—(TiN) | 0.7 | 30 | 4.9 | 685 | 488 |
| Example 25 | Completed | REM-Ca—Al—O—S—(TiN) | 0.8 | 36 | 4.0 | 683 | 489 |
| Example 26 | Completed | REM-Al—O—S—(TiN) | 5.0 | 22 | 6.3 | 749 | 535 |
| Example 27 | Completed | REM-Al—O—S—(TiN) | 2.7 | 27 | 4.9 | 696 | 488 |
| Example 28 | Completed | REM-Al—O—S—(TiN) | 0.8 | 29 | 3.4 | 695 | 497 |
| Comparative example 1 | Completed | $Al_2O_3$ | 0.002 | 41 | 22.9 | 642 | 482 |
| Comparative example 2 | Completed | REM-Al—O—S—(TiN) | 0.08 | 32 | 13.6 | 623 | 518 |
| Comparative example 3 | Completed | REM-Al—O—S—(TiN) | 4.5 | 30 | 32.0 | 636 | 490 |
| Comparative example 4 | Completed | $Al_2O_3$, REM-Al—O—S—(TiN) | 0.3 | 19 | 40.1 | 622 | 504 |
| Comparative example 5 | Completed | only center portion: REM-Al—O—S—(TiN) | 1.2 | 33 | 43.5 | 627 | 483 |
| Comparative example 6 | Completed | REM-Al—O—S | 6.5 | 30 | 36.5 | 608 | 485 |
| Comparative example 7 | Completed | REM-Al—O—S—(TiN) | 3 | 45 | 5.0 | 617 | 508 |

The results were shown in Table 4.

The oxide inclusions of examples Nos. 1 to 28, as shown in FIG. 1, were reformed into the composite inclusion that TiN was adhered to REM-Al—O or REM-Al—O—S and alumina cluster having a maximum diameter of 10 μm or more was not included. The total number of MnS having a maximum diameter of 10 μm or more and TiN having a maximum diameter of 1 μm or more, as shown in Table 4, was 10 pieces/mm$^2$ or less.

In addition, in the examples Nos. 1 to 28, fatigue strength obtained by rotating bending fatigue test was higher several tens of MPa than that of comparative examples Nos. 1 to 7, and thus, it is seen that excellent fatigue resistance were obtained.

In the comparative example 1, since Al was only added and REM was not added in the steel, there were many alumina clusters, MnS and TiN in the steel.

In the comparative example 2, since the amount of REM was small, there were many alumina clusters, MnS and TiN in the steel.

In the comparative example 3, since the amount of S was large, there were many MnS in the steel.

In the comparative example 4, since the reflux time after adding REM was shorter, there were many alumina clusters, MnS and TiN in the steel.

In the comparative example 5, since circulation flow rate of molten steel inside mold was slower, there were many TiN at the surface portion due to segregation of REM-Al—O or REM-Al—O—S at near the center portion of the cast piece.

In the comparative example 6, since holding time at 1250° C. to 1200° C. is shorter, there were many TiN in the steel.

In the comparative example 7, since the amount of REM was large, the maximum diameter of the composite inclusion to which TiN was adhered became larger.

In the comparative examples described above, the fatigue strengths of the products were poor due to the influence of the inclusions.

[Table 4]

INDUSTRIAL APPLICABILITY

According to the invention, the alumina is reformed into the REM-Al—O and it is possible to prevent coarsening oxide, in addition, S is fixed as REM-Al—O—S and it is possible to limit coarsening MnS, furthermore, TiN is conjugated to REM-Al—O—S inclusion and the number density of isolated TiN that is independently precipitated can be reduced. Therefore, it is possible to provide spring steel with excellent fatigue resistance. Accordingly, it can be said that the industrial applicability of the invention is high.

BRIEF DESCRIPTION OF THE REFERENCE SYMBOLS

A: REM-Al—O—S

B: TiN THAT IS COMPOSITELY PRECIPITATED AT SURFACE OF REM-Al—O—S

C: PRO-EUTECTOID CEMENTITE

What is claimed is:

1. A spring steel comprising as a chemical composition, by mass %:

C: 0.4% to less than 0.9%;

Si: 1.0% to 3.0%;

Mn: 0.1% to 2.0%;

Al: 0.01% to 0.05%;

REM: 0.0001% to 0.005%;

T.O: 0.0001% to 0.003%;

Ti: less than 0.005%;

N: 0.015% or less;
P: 0.03% or less;
S: 0.03% or less;
Cr: 0% to 2.0%;
Cu: 0% to 0.5%;
Ni: 0% to 3.5%;
Mo: 0% to 1.0%;
W: 0% to 1.0%;
B: 0% to 0.005%;
V: 0% to 0.7%;
Nb: 0% to 0.05%;
Ca: 0% to 0.0020%; and
the balance consisting of Fe and impurities, wherein;
the spring steel includes a composite inclusion of TiN adhered to an inclusion containing REM, O and Al;
a number of the composite inclusion is 0.004 pieces/$mm^2$ to 10 pieces/$mm^2$, and a maximum diameter of the composite inclusion is 2 μm to 40 μm; and
a sum of the number density of an alumina cluster having the maximum diameter of 10 μm or more, MnS having the maximum diameter of 10 μm or more and TiN having the maximum diameter of 1 μm or more is 10 pieces/$mm^2$ or less.

2. The spring steel according to claim 1, further comprising as the chemical composition, one or more kinds of elements selected from the group consisting of, by mass %:
Cr: 0.05% to 2.0%;
Cu: 0.1% to 0.5%;
Ni: 0.1% to 3.5%;
Mo: 0.05% to 1.0%;
W: 0.05% to 1.0%;
B: 0.0005% to 0.005%;
V: 0.05% 0.7%;
Nb: 0.005% 0.05%; and
Ca: 0.0001% 0.0020%.

3. A method of manufacturing the spring steel according to claim 1, the method comprising;
a process of performing a deoxidation by using Al and then performing a deoxidation by using REM for 5 minutes or longer when a molten steel having the chemical composition according to claim 1 is refined in a ladle with vacuum degassing,
a process of performing a circulation of the molten steel in a mold in a horizontal direction at 0.1 m/minute or faster when the molten steel is cast in the mold, and
a process of performing a soaking treatment in which a cast piece obtained by casting is held at a temperature region of 1200° C. to 1250° C. for 60 seconds to 150 seconds and then blooming the cast piece.

4. A spring comprising the spring steel according to claim 1.

* * * * *